US011795605B2

(12) United States Patent
Tuniki et al.

(10) Patent No.: US 11,795,605 B2
(45) Date of Patent: Oct. 24, 2023

(54) WASHING MACHINE APPLIANCE AND FILTRATION ASSEMBLY

(71) Applicant: Haier US Appliance Solutions, Inc., Wilmington, DE (US)

(72) Inventors: Sanjana Tuniki, Hyderabad (IN); John Joseph Roetker, Louisville, KY (US); Jay Pareshbhai Shinde, Hyderabad (IN); Sasikumar Durairaj, Hyderabad (IN); Pavan Kumar Madeti, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 94 days.

(21) Appl. No.: 17/579,977

(22) Filed: Jan. 20, 2022

(65) Prior Publication Data

US 2023/0228028 A1 Jul. 20, 2023

(51) Int. Cl.
*D06F 39/10* (2006.01)
*D06F 39/08* (2006.01)

(52) U.S. Cl.
CPC ..... *D06F 39/10* (2013.01); *D06F 39/085* (2013.01)

(58) Field of Classification Search
CPC .... D06F 39/10; D06F 39/083; D06F 2105/34; D06F 37/18; D06F 2103/14; D06F 39/08; D06F 39/14; A47L 15/4202; A47L 15/4208
USPC ..... 68/268
See application file for complete search history.

(56) References Cited

U.S. PATENT DOCUMENTS 2,298,096 A * 10/1942 Dunham ..... D06F 23/04 210/139
2,536,087 A * 1/1951 Powers ..... D06F 39/10 68/18 F
2,971,362 A * 2/1961 Olding ..... D06F 39/10 68/53
3,127,067 A * 3/1964 Hall et al. ..... D06F 39/02 68/17 R
3,769,818 A * 11/1973 Smith ..... D06F 37/145 210/167.01
3,891,548 A * 6/1975 Marcussen ..... B01D 35/28 210/791

(Continued)

FOREIGN PATENT DOCUMENTS

CN 103850090 B 2/2018
DE 102018216396 A1 3/2020

(Continued)

*Primary Examiner* — David G Cormier
*Assistant Examiner* — Thomas Bucci
(74) *Attorney, Agent, or Firm* — Dority & Manning, P.A.

(57) ABSTRACT

A washing machine appliance may include a cabinet, a tub, a lid, and a filter assembly. The cabinet may define an opening. The tub may be disposed within the cabinet for the receipt of articles therein. The lid may be movably mounted to the cabinet to selectively cover the opening and restrict access to the tub. The filter assembly may be mounted to the lid to move therewith. The filter assembly may include an assembly box defining a box compartment and an assembly outlet upstream from the tub to direct liquid thereto. The assembly box may be movable relative to the lid. The filter assembly may further include a filter cartridge selectively received within the box compartment to filter liquid upstream from the assembly outlet.

20 Claims, 10 Drawing Sheets

(56) References Cited

U.S. PATENT DOCUMENTS

| | | | | |
|---|---|---|---|---|
| 4,420,951 | A * | 12/1983 | Clearman | D06F 39/02 68/17 R |
| 2004/0200245 | A1* | 10/2004 | Cheo | D06F 39/02 68/17 R |
| 2009/0229314 | A1* | 9/2009 | Yoo | D06F 39/14 68/13 R |
| 2015/0096128 | A1* | 4/2015 | Sawford | D06F 39/14 68/17 R |
| 2019/0177905 | A1* | 6/2019 | Ayers | D06F 60/00 |
| 2020/0179846 | A1 | 6/2020 | Zupan | |
| 2020/0337518 | A1 | 10/2020 | Albert | |

FOREIGN PATENT DOCUMENTS

| | | | |
|---|---|---|---|
| EP | 3695768 | A1 | 8/2020 |
| EP | 3696311 | A1 | 8/2020 |
| KR | 20110009918 | A | 1/2011 |
| KR | 20200035191 | A | 4/2020 |
| WO | WO2020054475 | A1 | 3/2020 |
| WO | WO2020057820 | A1 | 3/2020 |
| WO | WO2020089727 | A1 | 5/2020 |
| WO | WO2020200453 | A1 | 10/2020 |
| WO | W02020251512 | A2 | 12/2020 |

* cited by examiner

WASHING MACHINE APPLIANCE AND FILTRATION ASSEMBLY

FIELD OF THE INVENTION

The present subject matter relates generally to washing machine appliances, and more particularly to filtration assemblies to filter fluid within a washing machine appliance.

BACKGROUND OF THE INVENTION

Washing machine appliances generally include a tub for containing water or wash fluid (e.g., water, detergent, bleach, wash additives, etc.). A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc.

During operation of certain washing machine appliances, a volume of wash fluid or water is directed to the wash chamber. The volume of wash fluid or water may be, for example, recirculated or agitated through the wash basket before being drained from the washing machine appliance. Oftentimes, clothes or articles in wash chamber can release (e.g., shed) microfibers, which can then become suspended or mixed with water or wash fluid within the wash chamber. Subsequently, such microfibers can be circulated through the appliance before being released with the wash fluid, for instance, to a residential wastewater system. In some cases, it is possible for the microfibers to be introduced to nearby aquatic environments. Increasingly, the introduction of such microfibers has become a source of concern, as the exact effects of microfibers on the larger environment are not yet known.

As a result, it would be useful to provide a washing machine appliance or assembly with one or more features for removing or filtering, for instance, microfibers from the wash fluid of a washing machine appliance. In particular, it may be advantageous to provide such features without increasing the size of a washing machine appliance cabinet or otherwise requiring existing components to be significantly modified.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a washing machine appliance is provided. The washing machine appliance may include a cabinet, a tub, a lid, and a filter assembly. The cabinet may define an opening. The tub may be disposed within the cabinet for the receipt of articles therein. The lid may be movably mounted to the cabinet to selectively cover the opening and restrict access to the tub. The filter assembly may be mounted to the lid to move therewith. The filter assembly may include an assembly box defining a box compartment and an assembly outlet upstream from the tub to direct liquid thereto. The assembly box may be movable relative to the lid. The filter assembly may further include a filter cartridge selectively received within the box compartment to filter liquid upstream from the assembly outlet.

In another exemplary aspect of the present disclosure, a washing machine appliance is provided. The washing machine appliance may include a cabinet, a tub, a supply conduit, a lid, and a filter assembly. The cabinet may define an opening. The tub may be disposed within the cabinet for the receipt of articles therein. The lid may be movably mounted to the cabinet to selectively cover the opening and restrict access to the tub. The filter assembly may be mounted to the lid to move therewith. The filter assembly may include a mounting bracket fixed to the lid in fluid communication with the supply conduit to receive the fluid flow therefrom. The filter assembly may further include an assembly box movably mounted to the mounting bracket to move relative thereto. The assembly box may define a box compartment and an assembly outlet upstream from the tub to direct liquid thereto. The assembly box may be movable relative to the lid. The assembly may still further include a filter cartridge selectively received within the box compartment to filter liquid upstream from the assembly outlet.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
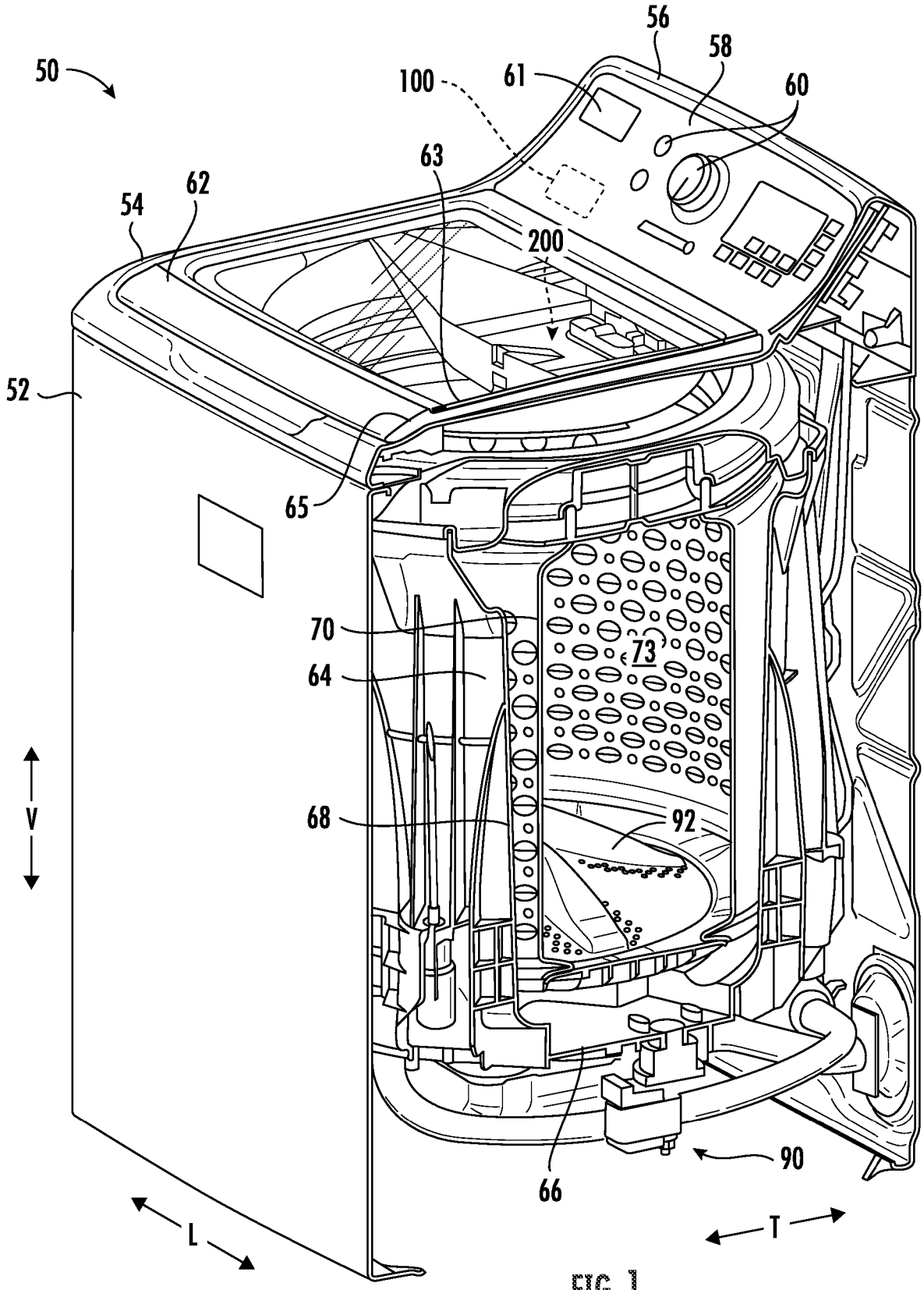
FIG. 1 provides a cross-sectional perspective view of a washing machine according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
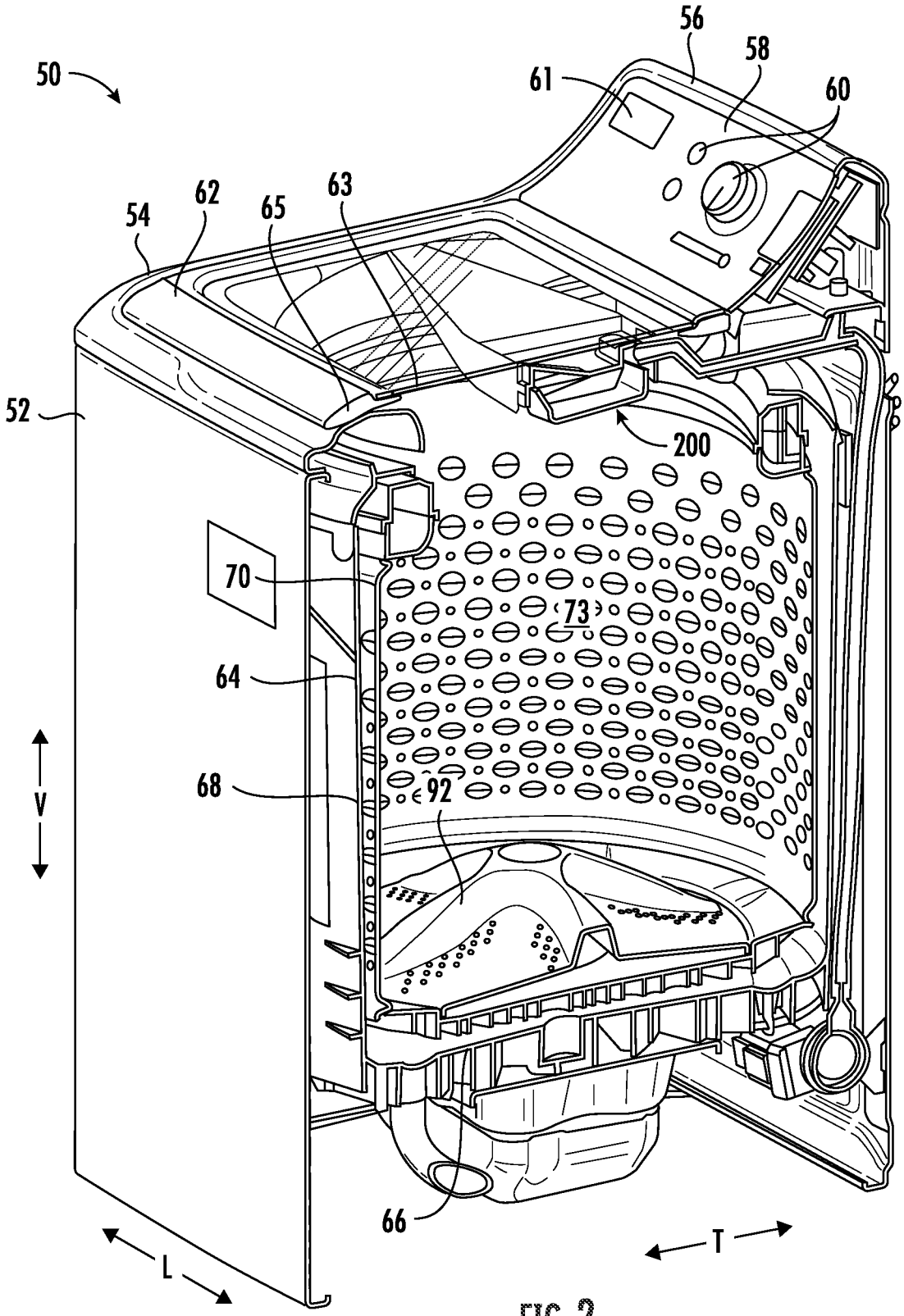
FIG. 2 provides another cross-sectional perspective view of the exemplary washing machine appliance of FIG. 1.
Figure 3:
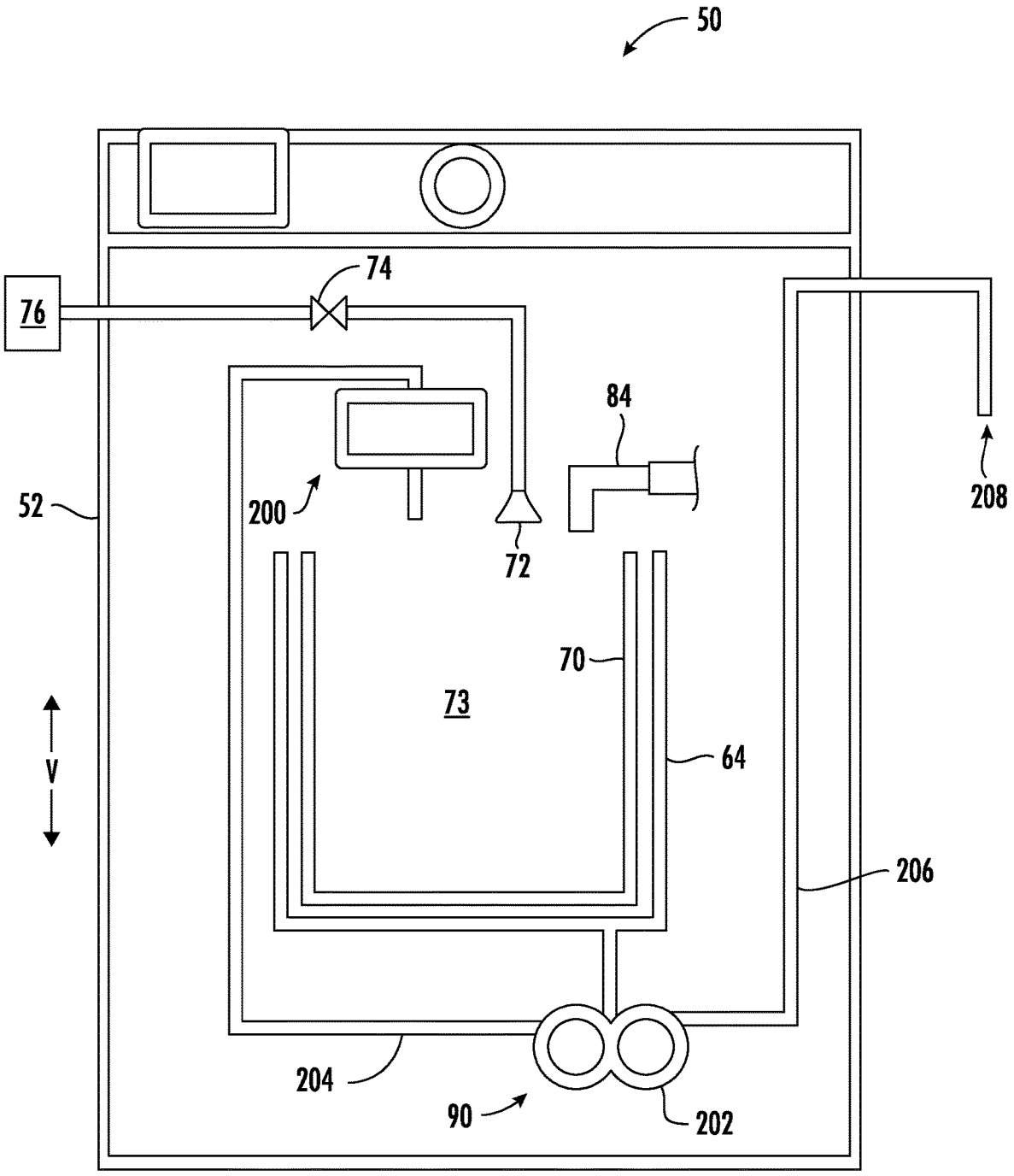
FIG. 3 provides a schematic elevation view of the exemplary washing machine appliance of FIG. 1.
Figure 4:
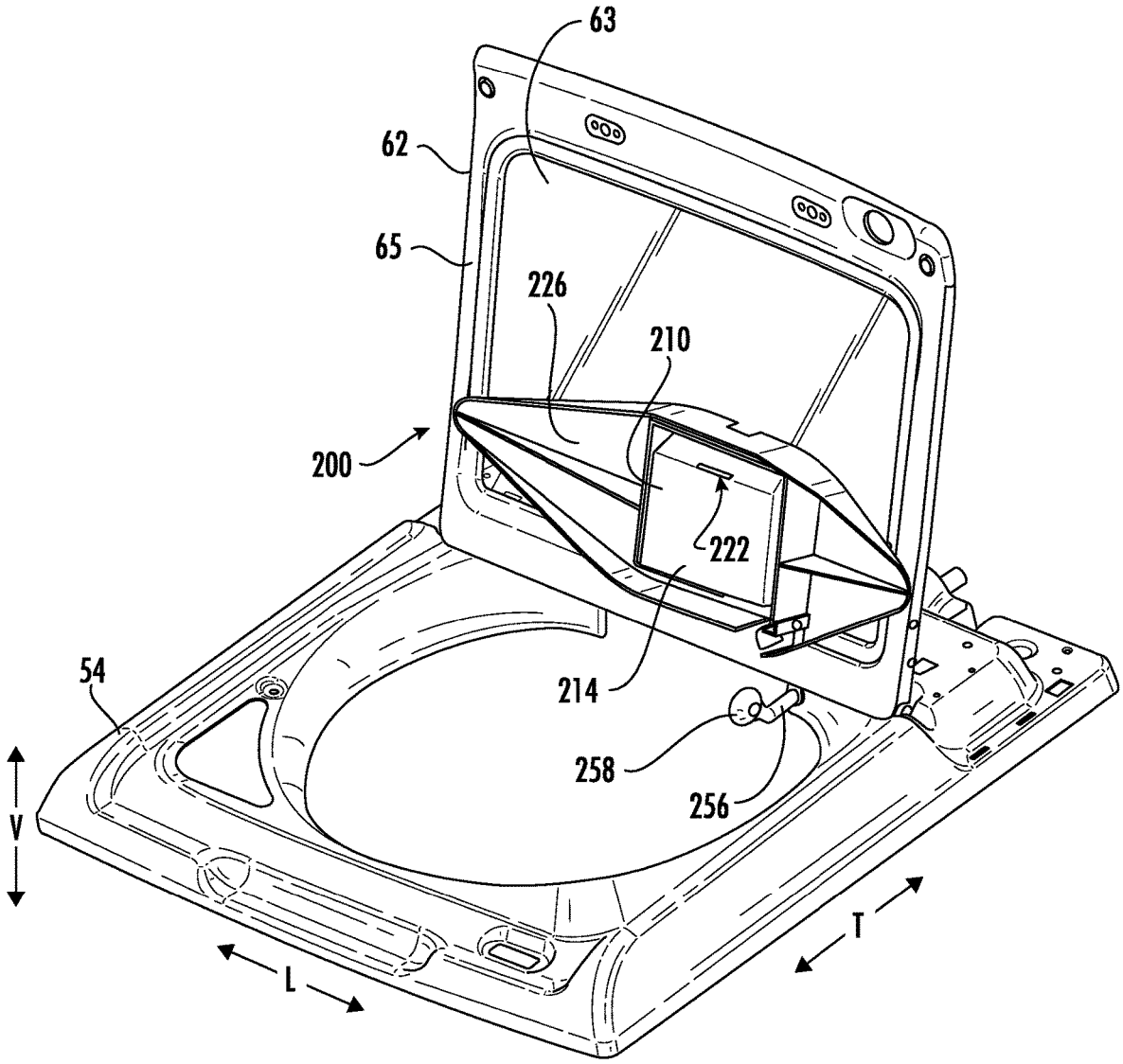
FIG. 4 provides a perspective view of the lid assembly of the exemplary washing machine appliance of FIG. 1.
Figure 5:
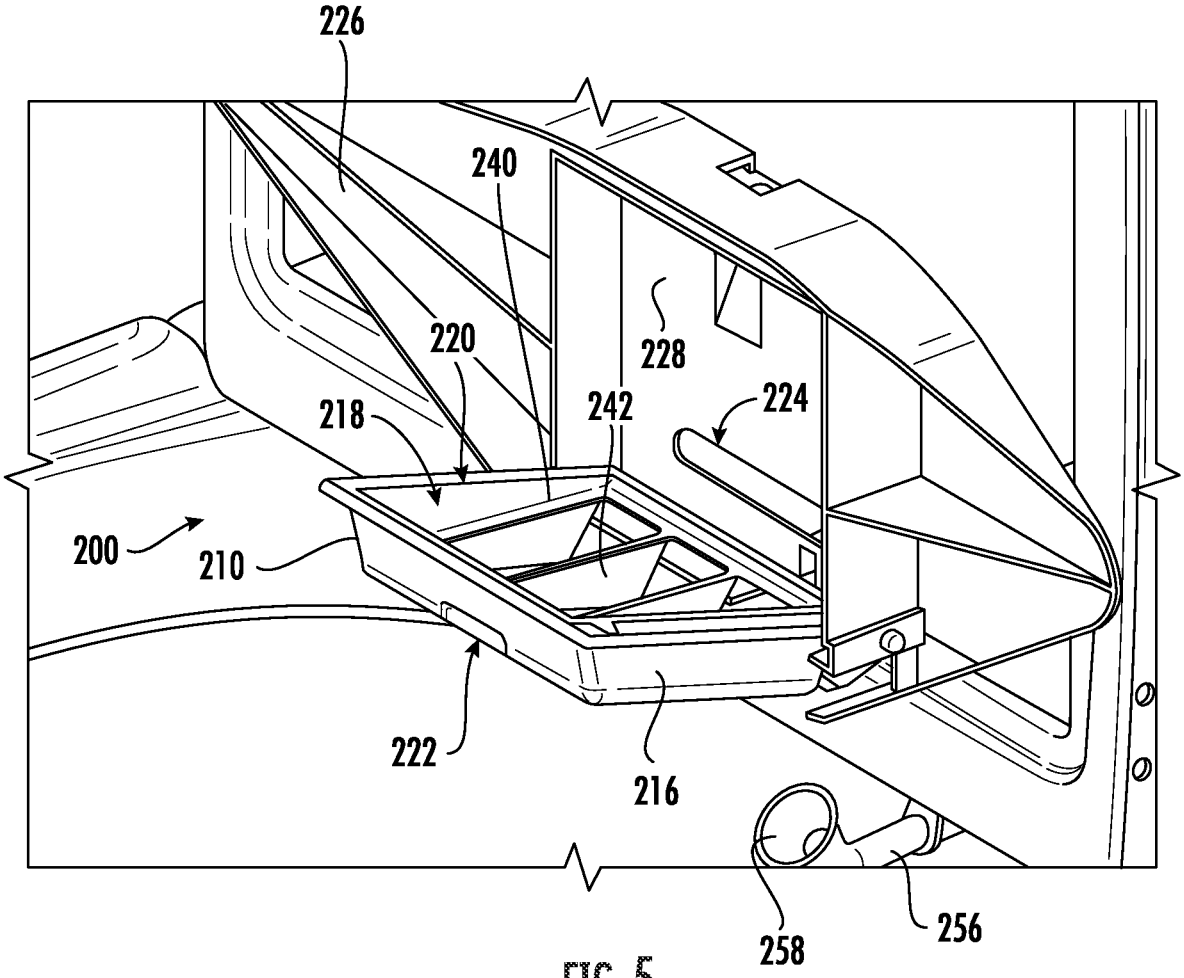
FIG. 5 provides a perspective view of the exemplary lid assembly of FIG. 1, wherein an assembly box is illustrated in an opened position.
Figure 6:
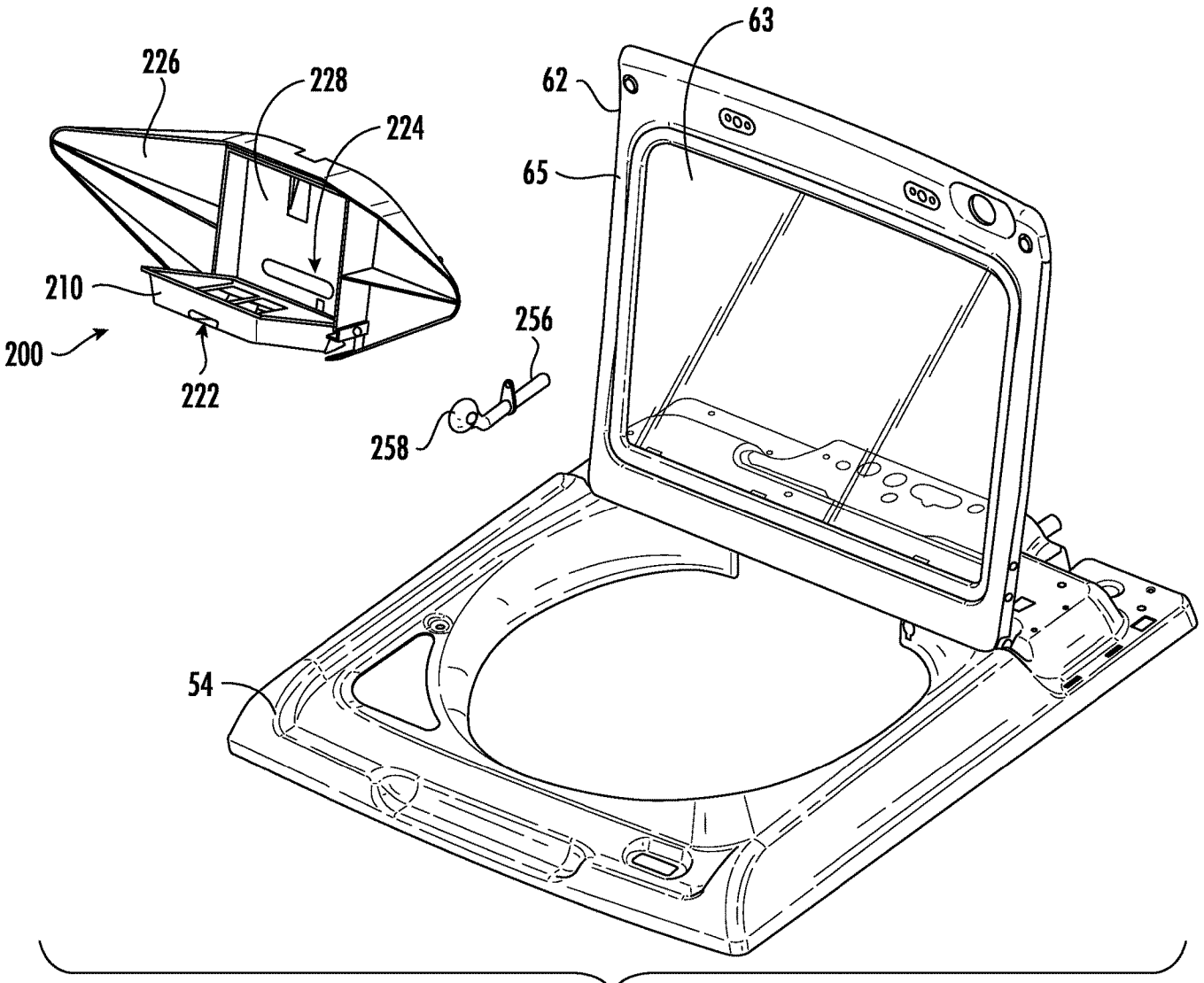
FIG. 6 provides an exploded perspective view of a portion of the exemplary lid assembly of FIG. 1.
Figure 7:
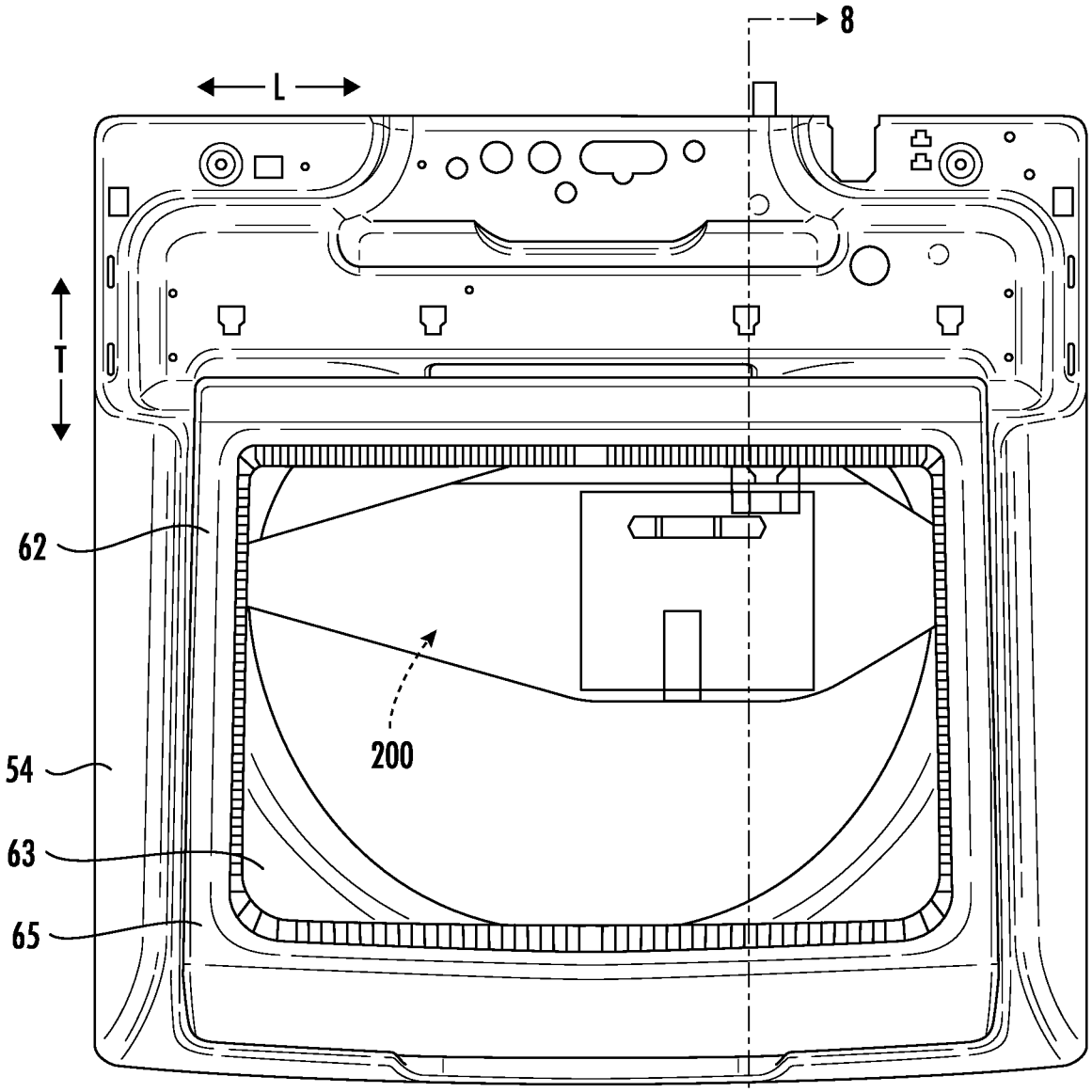
FIG. 7 provides a top perspective view of a portion of the exemplary lid assembly of FIG. 1, wherein the lid is in a closed position.
Figure 8A:
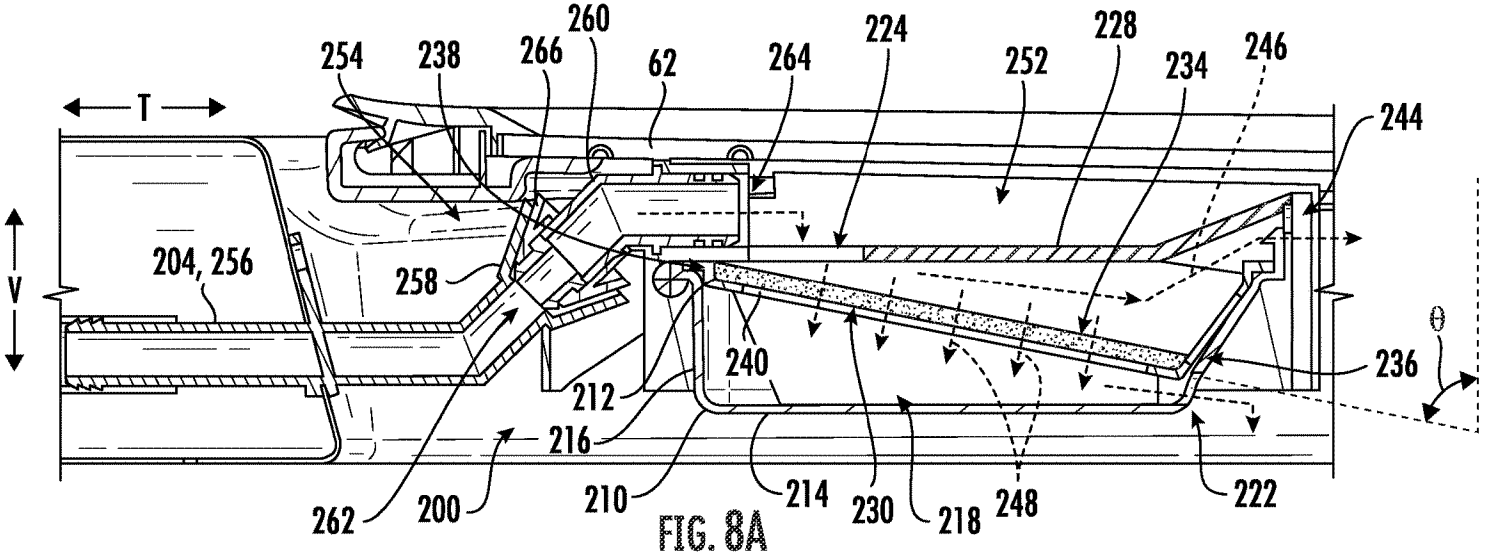
FIG. 8A provides a section view of the exemplary lid assembly of FIG. 7, taken along the lines 8-8, wherein the lid is in a closed position.
Figure 8B:
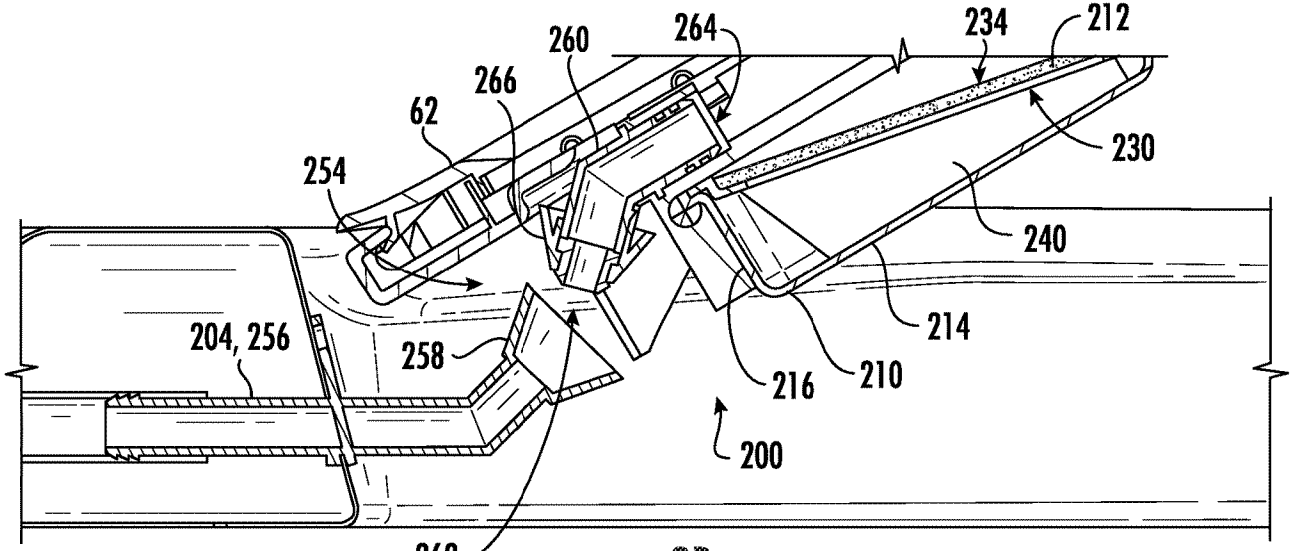
FIG. 8B provides a section view of the exemplary lid assembly of FIG. 7, taken along the lines 8-8, wherein the lid is in an open position.

Turning now to the figures, FIGS. 1 and 2 provides cross-sectional perspective view a washing machine appliance 50 according to an exemplary embodiment of the present disclosure. FIG. 3 provides a schematic view of the washing machine appliance As shown, washing machine appliance 50 includes a cabinet 52 and a cover 54. In some embodiments, a backsplash 56 extends from cover 54, and a control panel 58, including a plurality of input selectors 60, is coupled to backsplash 56. Control panel 58 and input selectors 60 collectively form a user interface input for operator selection of machine cycles and features, and in certain embodiments, a display 61 indicates selected features, a countdown timer, and other items of interest to machine users. A lid 62 is mounted to cover 54 and is rotatable between an open position (see FIG. 4) facilitating access to a wash tub 64 located within cabinet 52 and a closed position (see FIGS. 1 and 2) forming an enclosure over tub 64.

As illustrated in FIGS. 1 and 2, washing machine appliance 50 is a vertical axis washing machine appliance. While the present disclosure is discussed with reference to an exemplary vertical axis washing machine appliance, those of ordinary skill in the art, using the disclosures provided herein, should understand that the subject matter of the present disclosure may be equally applicable to other washing machine appliances or configurations.

In some embodiments, lid 62 includes a transparent panel 63, which may be formed of for example glass, plastic, or any other suitable material. The transparency of the panel 63 allows users to see through the panel 63, and into the tub 64 when the lid 62 is in the closed position. In some embodiments, the panel 63 may itself generally form the lid 62. In other embodiments, the lid 62 may include the panel 63 and a frame 65 surrounding and encasing the panel 63. Alternatively, panel 63 need not be transparent.

Generally, tub 64 includes a bottom wall 66 and a sidewall 68. Moreover, a basket 70 is rotatably mounted within tub 64. In some embodiments, tub 64 includes a bottom wall 66 and a sidewall 68. A wash drum or wash basket 70 is rotatably mounted within tub 64. In particular, basket 70 is rotatable about a central or rotation axis, which may when properly balanced and positioned in the embodiment illustrated be a vertical axis. Thus, washing machine appliance is generally referred to as a vertical axis washing machine appliance. Basket 70 defines a wash chamber 73 for receipt of articles for washing and extends, for example, vertically, between a bottom portion and a top portion. Basket 70 includes a plurality of openings or perforations therein to facilitate fluid communication between an interior of basket 70 and tub 64.

In optional embodiments, a nozzle 72 is configured for flowing a liquid into tub 64. For instance, nozzle 72 may be positioned at or adjacent to a top portion of basket 70. Nozzle 72 may be in fluid communication with one or more water sources 76 in order to direct liquid (e.g. water) into tub 64 or onto articles within chamber 73 of basket 70. Nozzle 72 may further include apertures through which water may be sprayed into the tub 64. The apertures may, for example, may be tubes extending from the nozzles 72 as illustrated, or simply holes defined in the nozzles 72 or any other suitable openings through which water may be sprayed. Nozzle 72 may additionally include other openings, holes, etc. (not shown) through which water may be flowed (e.g., sprayed or poured) into the tub 64.

A valve assembly 74, which may include one or more valves, regulates the flow of liquid through nozzle 72. For example, valve assembly 74 (and each valve thereof) can selectively adjust between a closed position in order to terminate or obstruct the flow of liquid to and through nozzle 72 and an open position in order to allow the flow of liquid to and through nozzle 72. The valve assembly 74 may be in fluid communication with one or more external water sources 76 (e.g., a hot water source or a cold water source, as would be understood).

An additive dispenser 84 may additionally be provided for directing a wash additive, such as detergent, bleach, liquid fabric softener, etc., into the tub 64. For example, dispenser 84 may be in fluid communication with nozzle 72 such that water flowing through nozzle 72 flows through dispenser 84, mixing with wash additive at a desired time during operation to form a liquid or wash fluid, before being flowed into tub 64. In some embodiments, nozzle 72 is a separate downstream component from dispenser 84. In other embodiments, nozzle 72 and dispenser 84 may be integral, with a portion of dispenser 84 serving as the nozzle 72.

A pump assembly 90 is mounted within cabinet 52 (e.g., beneath tub 64 or otherwise below the upper end of cabinet 52) to facilitate the circulation or draining of wash fluid from wash tub 64 or basket 70. Generally, pump assembly 90 includes a circulation pump 202 having a pump motor and in fluid communication with (e.g., mounted along) a supply or recirculation conduit 204. As shown, recirculation conduit 204 generally extends within cabinet 52, such as from a bottom portion of tub 64, to direct circulated wash fluid out of tub 64 before returning wash fluid to tub 64 or wash chamber 73 (e.g., at a top portion of the tub 64 or, optionally, apart from nozzle 72 or dispenser 84), such as might be driven by circulation pump 202. As will be described in greater detail below, a filter assembly 200 may be provided in fluid communication with recirculation conduit 204 or circulation pump 202, generally. As an example, filter assembly 200 may be mounted in fluid communication between circulation pump 202 and wash tub 64. In turn, wash fluid being circulated within cabinet 52 may be filtered (e.g., selectively filtered) prior to being returned to wash chamber 73 or wash tub 64.

Separate from or in addition to recirculation conduit 204, pump assembly 90 may generally include a drain conduit 206 extending through at least a portion of cabinet 52 downstream from wash tub 64 or wash chamber 73 to selectively drain wash fluid from appliance 50 through a drain outlet 208, as would be understood (e.g., to a building plumbing system discharge line downstream from drain outlet 208 or a wastewater system, generally). For instance, drain conduit 206 may extend downstream from circulation pump 202, which may be configured to selectively and alternately direct wash fluid to recirculation conduit 204 or drain conduit 206 (e.g., as directed by a controller 100). Thus, circulation pump 202 may have at least two discrete fluid paths that can be selected to alternately direct wash fluid through either the recirculation conduit 204 or the drain conduit 206. Alternatively, a separate drain pump (not pictured) having a pump motor may be provided along or otherwise in fluid communication with drain conduit 206 (e.g., apart from recirculation conduit 204) to selectively motivate wash fluid from the wash tub 64 or wash chamber 73 and outside of the appliance through drain outlet 208 (e.g., independent of circulation pump 202). In such embodiments having a discrete drain pump, both the drain pump and circulation pump may be fed by a single common manifold that is in fluid communication between the wash chamber 73 and the pair of pumps or, alternatively, discrete corresponding manifolds that are spaced apart from each other and separately connected to wash tub 64 (e.g., in fluid parallel), as would be understood in light of the present disclosure.

An agitator or agitation element 92 (e.g., shown as an impeller, but which also may include an extended agitator post) may be disposed in basket 70 to impart an oscillatory motion to articles and liquid in chamber 73 of basket 70. In various exemplary embodiments, agitation element 92 includes a single action element (i.e., oscillatory only), double action (oscillatory movement at one end, single direction rotation at the other end) or triple action (oscillatory movement plus single direction rotation at one end, single direction rotation at the other end). As generally illustrated in FIGS. 1 and 2, agitation element 92 is oriented to rotate about an axis parallel to the vertical direction V (e.g., the central axis). Alternatively, basket 70 may provide such agitating movement, and agitation element 92 is not required. Basket 70 and agitation element 92 are driven by a motor. The motor may, for example, be a pancake motor, direct drive brushless motor, induction motor, or other motor suitable for driving basket 70 and agitation element 92. Washing machine appliance 50 may also include a brake assembly (not shown) selectively applied or released for respectively maintaining basket 70 in a stationary position within tub 64 or for allowing basket 70 to spin within tub 64.

Operation of washing machine appliance 50 is controlled by a processing device or controller 100, that is operatively coupled to the input selectors 60 located on washing machine backsplash 56 (shown in FIG. 1) for user manipulation to select washing machine cycles and features. Controller 100 may further be operatively coupled to various other components of appliance 50, such as valve assembly 74, pump assembly 90, and one or more suitable sensors, etc. In response to user manipulation of the input selectors 60, controller 100 may operate the various components of washing machine appliance 50 to execute selected machine cycles and features.

Controller 100 may include a memory (e.g., non-transitive media) and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor (e.g., using a combination of discrete analog or digital logic circuitry, such as switches, amplifiers, integrators, comparators, flip-flops, AND gates, and the like) to perform control functionality instead of relying upon software. Control panel 58 and other components of washing machine appliance 50 may be in communication with controller 100 via one or more signal lines or shared communication busses.

In an illustrative embodiment, a load of laundry articles are loaded into chamber 73 of basket 70, and washing operation is initiated through operator manipulation of control input selectors 60. Tub 64 is filled with liquid, such as water, and may be mixed with detergent to form a wash fluid. Valve assembly 74 can be opened to initiate a flow of liquid and resulting wash fluid into tub 64 via nozzle 72, and tub 64 can be filled to the appropriate level for the amount of articles being washed. Once tub 64 is properly filled with wash fluid, the contents of the basket 70 are agitated with agitation element 92 or by movement of the basket 70 for cleaning of articles in basket 70 (e.g., as part of an agitation phase of a wash cycle). More specifically, agitation element 92 or basket 70 is moved back and forth in an oscillatory motion. Additionally or alternatively, circulation pump 202 may be activated and, thereby, motivate water or wash fluid from the wash chamber 73. After being motivated from wash chamber, water or wash fluid may further be motivated (e.g., by circulation pump 202) back to wash chamber 73, such as through filter assembly 200 or recirculation conduit 204 generally.

After the agitation phase of the wash cycle is completed, tub 64 is drained, such as through use of pump assembly 90. Laundry articles can then be rinsed by again adding fluid to tub 64. Depending on the particulars of the cleaning cycle selected by a user, agitation element 92 or basket 70 may again provide agitation within basket 70. After a rinse cycle, tub 64 is again drained, such as through use of pump assembly 90. Further, in exemplary embodiments, one or more spin cycles may be performed. In particular, a spin cycle may be applied after the wash cycle(s) or after the rinse cycle(s) in order to wring excess wash fluid from the articles being washed. During a spin cycle, basket 70 is rotated at relatively high speeds, as discussed further herein.

While described in the context of specific embodiments of washing machine appliance 50, using the teachings disclosed herein it will be understood that washing machine appliance 50 is provided by way of example only. Other washing machine appliances having different configurations, different appearances, or different features may also be utilized with the present subject matter as well.

Figure 9:
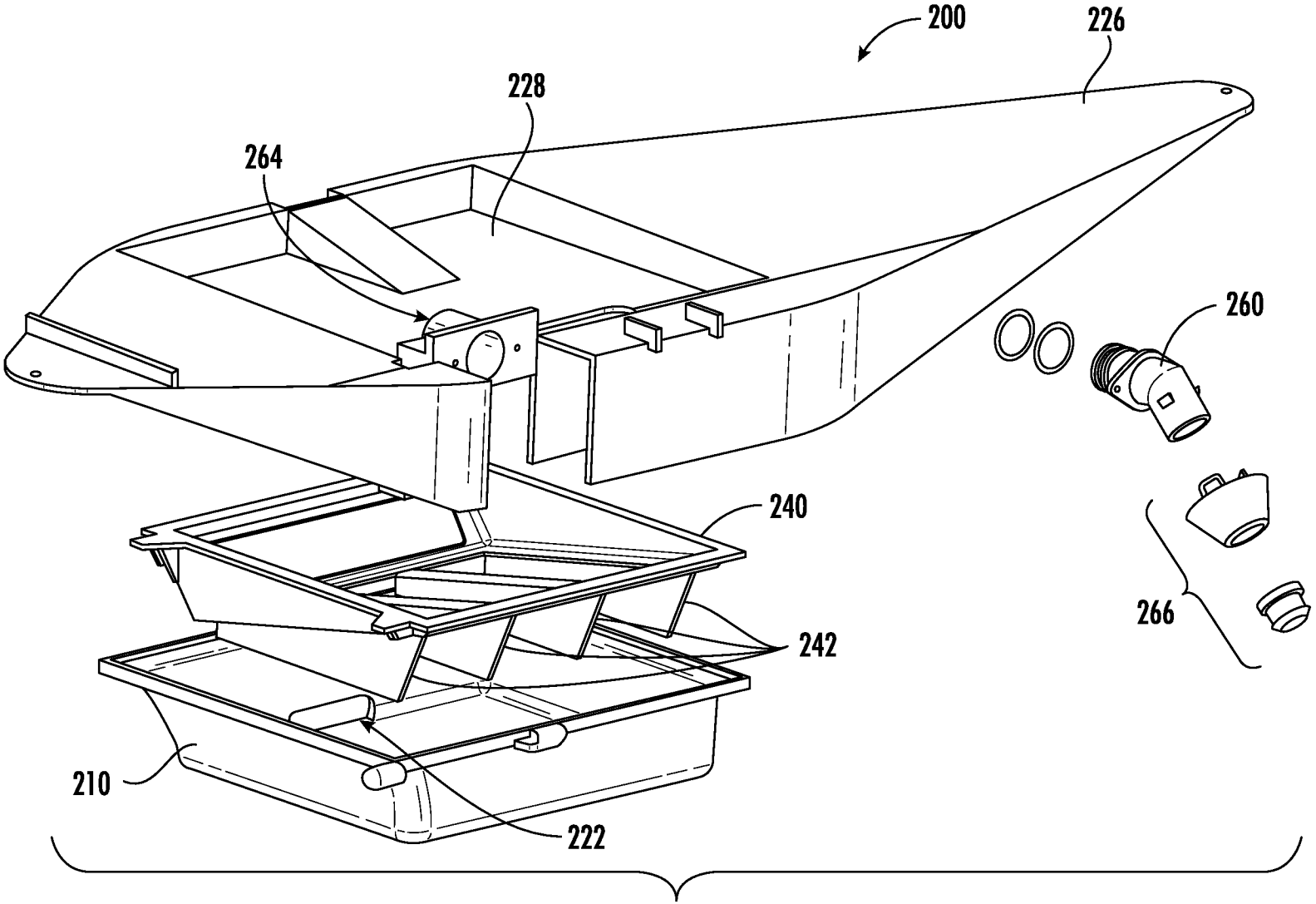
FIG. 9 provides an exploded perspective view of a portion of the filter assembly of the exemplary lid assembly of FIG. 4.
Figure 11:
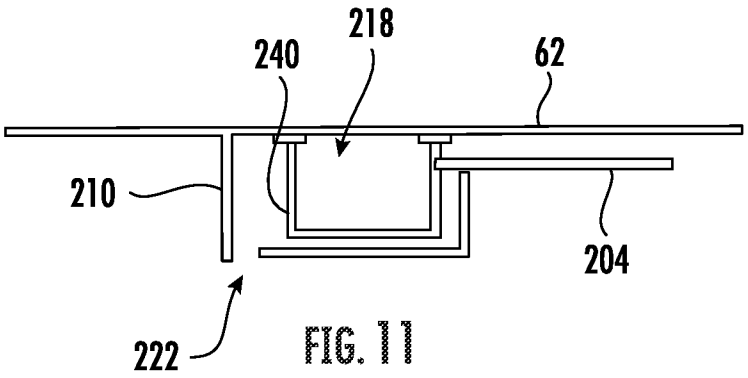
FIG. 11 provides a schematic elevation view of a filter assembly according to exemplary embodiments of the present disclosure, wherein a filter cartridge is atmospherically sealed.
Figure 10:
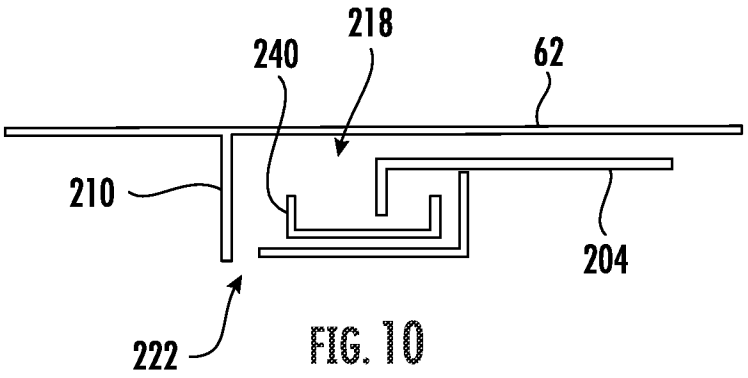
FIG. 10 provides a schematic elevation view of a filter assembly according to exemplary embodiments of the present disclosure, wherein a filter cartridge is open to atmospheric pressure.

Turning now to FIGS. 3 through 11, exemplary embodiments of filter assembly 200 (e.g., included with at least a portion of the lid assembly of for the lid 62) will be described in detail. FIGS. 3 through 7 provide various views of the lid assembly and portions of filter assembly 200 held above wash chamber 73 (FIGS. 1 and 2). FIG. 9 provides an exploded perspective view of filter assembly 200. FIG. 10 provides a schematic elevation view of a filter assembly 200 according to exemplary embodiments of the present disclosure, wherein a filter cartridge is open to atmospheric pressure. FIG. 11 provides a schematic elevation view of a filter assembly 200 according to other exemplary embodiments of the present disclosure, wherein a filter cartridge is atmospherically sealed.

Advantageously, embodiments of the below-described filter assembly 200 may facilitate the selective filtering or removal of various particulates (e.g., microfibers) from water or wash fluid within washing machine appliance.

As shown, filter assembly 200 is mounted to lid 62. Thus, at least a portion of filter assembly 200 may move (e.g., rotate) with lid 62 relative to cabinet 52. When assembled, filter assembly 200 may thus be held above at least a portion of wash tub 64 or wash chamber 73. Notably, dedicated or additional space within the cabinet 52 (e.g., to accommodate filter assembly 200) is not required. In some embodiments, filter assembly 200 defines at least one assembly outlet 222 through which water or wash fluid may flow (e.g., downstream from recirculation conduit 204) before entering or returning to wash tub 64 or wash chamber 73.

Generally, filter assembly 200 includes an assembly box 210 and a filter cartridge 212 to filter liquids (e.g., water or wash fluid) flowing therethrough. As shown, assembly box 210 includes one or more walls defining a box compartment 218, or at least a portion thereof. For instance, assembly box 210 may include a base wall 214 and one or more side or peripheral walls 216 extending (e.g., vertically upward) from base wall 214. In certain embodiments, one or more of the walls of assembly box 210 defines assembly outlet 222. In the illustrated embodiments, for instance, assembly box 210 defines assembly outlet 222 through a peripheral sidewall 216 (e.g., a forwardmost peripheral wall or peripheral wall that is otherwise proximal or closest to the central axis of the basket 70). Additionally or alternatively, assembly outlet 222 may be defined at the bottom half of assembly box 210, such as through base wall 214 or below a vertical half-way point on a peripheral sidewall 216. Optionally, assembly box 210 may be open (e.g., along the vertical direction V), such as opposite of the base wall 214. Thus, assembly box 210 may define a box opening 220 (e.g., separate from assembly outlet 222. In some such embodiments, assembly box 210 may be permitted to receive the filter cartridge 212 through box opening 220, such as for the removal from or insertion to assembly box 210.

As noted above, filter assembly 200, including assembly box 210, is generally movable with lid 62 relative to cabinet 52 or wash tub 64. In some embodiments, assembly box 210 is further movable relative to lid 62. Specifically, assembly box 210 may move relative to lid 62 between a use position (e.g., FIGS. 4, 7, and 8) and a maintenance position (e.g., FIG. 5). In the use position, box compartment 218 is generally closed or covered to prevent access by a user (e.g., to secure filtration cartridge within box compartment 218). By contrast in the maintenance position, box compartment 218 may be opened or otherwise accessible to a user (e.g., such that filter cartridge 212 may be inserted, removed, or otherwise accessed within box compartment 218). In certain embodiments, assembly box 210 is pivotably mounted to lid 62. Thus, assembly box 210 may pivot relative to lid 62 about a box axis (e.g., parallel to the lateral direction L or a pivot axis of lid 62) between the use and maintenance positions. A friction fit or engagement tab provided on assembly box 210 (e.g., forward from or opposite of the box axis) may selectively hold the free end of assembly box 210 to mounting bracket 226 (e.g., in the use position).

In exemplary embodiments, a mounting bracket 226 supports or secures assembly box 210 on lid 62 (e.g., below a bottom or interior-facing surface of lid 62). As shown, mounting bracket 226 may be mounted (e.g., fixedly mounted) to lid 62, such as through one or more mechanical fasteners, adhesives, or bonding components (e.g., joining mounting bracket 226 to frame 65). In some such embodiments, mounting bracket 226 extends (e.g., laterally) directly beneath panel 63. When assembled, mounting bracket 226 may be fixed above assembly box 210. In some embodiments, mounting bracket 226 defines the box axis (or pivot supports) for assembly box 210. Thus, mounting bracket 226 may be pivotable relative to mounting bracket 226. As shown, an overhead wall 228 of mounting bracket 226 may be disposed directly above assembly box 210 and span across box opening 220. The one or more peripheral walls 216 may extend to or selectively engage with, for instance, a portion of the overhead wall 228 of mounting bracket 226. In turn, the overhead wall 228 of mounting bracket 226 may cover box compartment 218 or otherwise restrict access thereto, such as when assembly box 210 is in the use position.

As noted above, filter cartridge 212 is selectively or removably received within box compartment 218 to filter wash fluid therein (e.g., upstream from assembly outlet 222).

Generally, filter cartridge 212 may complement at least a portion of box compartment 218 upstream from assembly outlet 222 (e.g., downstream from an assembly inlet 224). In some embodiments, filter cartridge 212 is matched to match (e.g., span the distance of) the lateral width or transverse depth of box compartment 218. Wash fluid flowing through box compartment 218 may thus be forced (e.g., downward as directed by positive pressure or gravity) through filter cartridge 212 before flowing to assembly outlet 222.

Filter cartridge 212 itself may be formed from or include any suitable filtration media (e.g., to filter shed microfibers therethrough). For instance, filter cartridge 212 may include a suitable mesh, activated carbon, cellulose, woven, or unwoven filtration media to collect microfibers carried with wash fluid within box compartment 218 such that such microfibers are separated from the wash fluid before the wash fluid flows to the assembly outlet 222.

As received within box compartment 218, filter cartridge 212 may be held upstream from assembly outlet 222. In some embodiments, filter cartridge 212 is disposed above assembly outlet 222. A lower surface 230 of filter cartridge 212 may be vertically spaced apart from and above the assembly outlet 222. In additional or alternative embodiments, filter cartridge 212 may be received within box compartment 218 at a non-orthogonal angle θ (e.g., relative to the vertical direction V). For instance, filter cartridge 212 may be slanted forward such that a forward end 236 (e.g., at an upper surface 232 or lower surface 230) of filter cartridge 212 may be disposed at a lower relative height than a rearward end 238 (e.g., of the corresponding upper surface 232 or lower surface 230). Additionally or alternatively, forward end 236 of filter cartridge 212 may be proximal to assembly outlet 222 (e.g., along the transverse direction T) while the rearward end 238 of filter cartridge 212 is distal to assembly outlet 222 (e.g., along the transverse direction T). which may be proximal to assembly outlet 222.

In exemplary embodiments, filter cartridge 212 is supported on a support frame 240 that is disposed within assembly box 210. As shown, support frame 240 defines one or more frame openings (e.g., vertical passages) through which water or wash fluid from the filter cartridge 212 may flow. For instance, such frame openings may be defined between adjacent scaffolding members of a slotted cartridge scaffold 242. The filter cartridge 212 may rest on top of the slotted cartridge scaffold 242. In the illustrated embodiments, support frame 240 rests on base wall 214. The slotted cartridge scaffold 242 extends downwards (e.g., from the lower surface 230 of the filter cartridge 212) and to the base wall 214. In certain embodiments, the slotted cartridge scaffold 242 extends (e.g., along the transverse direction T and downward relative to the vertical direction V) at the non-orthogonal angle θ. At least a portion of wash fluid within the box compartment 218 may thus generally flow downward along the upper surface 232 of filter cartridge 212 and collect proximal to the forward end 236 of assembly box 210 before flowing (e.g., downward) through filter cartridge 212 and support frame 240, then subsequently to assembly outlet 222.

Separate from or in addition to assembly outlet 222, filter assembly 200 may define a bypass outlet 244 and a bypass path 246 upstream therefrom. Both bypass outlet 244 and assembly outlet 222 may be defined downstream from the assembly inlet 224. However, bypass outlet 244 and assembly outlet 222 may provide discrete exit points for fluid within box compartment 218. In particular, bypass path 246 may be defined in fluid parallel to the filter cartridge 212 (i.e., a filtered path 248). Wash fluid exiting filter assembly 200 through bypass outlet 244 may thus generally be unfiltered by filter cartridge 212. In the illustrated embodiments, bypass path 246 extends above the filter cartridge 212. Bypass outlet 244 is vertically spaced apart from (e.g., above) assembly outlet 222, such as at the forward end 236 of filter assembly 200. Optionally, mounting bracket 226 may define bypass outlet 244 (e.g., directly above assembly outlet 222. If a volume of wash fluid within box compartment 218 is unable to pass through filter cartridge 212, wash fluid may collect above filter cartridge 212 (e.g., at the forward end 236 of filter assembly 200) before being permitted to spill over or otherwise escape box compartment 218. Notably, bypass outlet 244 may prevent excessive pressures or volumes of wash fluid from collecting within box compartment 218 (e.g., in the event that filter cartridge 212 becomes dirty or assembly outlet 222 is blocked).

As noted above, an assembly inlet 224 is defined by filter assembly 200. Specifically, assembly inlet 224 is defined upstream from box compartment 218 and downstream from circulation pump 202 or recirculation conduit 204 to permit wash fluid from the circulation pump 202 or recirculation conduit 204 to the box compartment 218. In some embodiments, assembly outlet 222 is disposed above assembly outlet 222 or filter cartridge 212 (e.g., at the rearward end 238 of filter assembly 200 or otherwise distal to the central axis of basket 70). For instance, assembly outlet 222 may be defined by mounting bracket 226. As shown, assembly outlet 222 may be defined through overhead wall 228 (e.g., along the vertical direction V). A conduit exhaust 264 may be disposed above inlet 224 downstream from recirculation conduit 204. Optionally, a collection pocket 252 may be defined above overhead wall 228 (e.g., between overhead wall 228 and a bottom-facing surface of lid 62) to permit wash fluid to temporarily collect, slow, or disperse before flowing through assembly inlet 224.

Generally, any suitable fluid connection may be provided between the recirculation conduit 204 and the filter assembly 200 (e.g., at the mounting bracket 226 or otherwise upstream from assembly inlet 224). In the illustrated embodiments of FIGS. 4 through 9, a separable connection assembly 254 is provided. Specifically, a static pipe 256 is fixed to cabinet 52 downstream from (or as part of) recirculation conduit 204. Optionally, a flared female coupling 258 is provided within static pipe 256. The flared female coupling 258 may be directed upward and forward (e.g., such that the flares project outward in a conical shape from static pipe 256). Separately, a movable pipe 260 extends (e.g., downward and rearward) from assembly bracket. The movable pipe 260 may extend from a connection inlet 262 to the conduit exhaust 264. At or about the connection inlet 262, a tapered male coupling 266 may be provided. As shown, especially between FIGS. 8A and 8B, the separable connection assembly 254 may selectively join the filter assembly 200 to the recirculation conduit 204 in the use position. In the use position (FIG. 8A) movable pipe 260 is connected to the static pipe 256. The tapered male coupling 266 is received within the flared female coupling 258 to direct wash fluid directly from the static pipe 256 to the movable pipe 260 (and subsequently the assembly box 210). By contrast, in the maintenance position (FIG. 8B), movable pipe 260 is spaced apart from the static pipe 256. The tapered male coupling 266 is held outside of the flared female coupling 258.

It is noted that although the embodiments of FIGS. 4 through 9 illustrate box compartment 218 as having a separable, atmospherically open fluid connection with recirculation conduit 204, alternative embodiments may have a fixed connection (e.g., FIG. 10), such as might be provided by a flexible tubing, or an atmospherically sealed connection (e.g., FIG. 11), such that box compartment 218 could be pressurized above atmospheric pressure based on the fluid flow thereto. Such embodiments would generally be understood in light of the present disclosure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:
- a cabinet defining an opening;
- a tub disposed within the cabinet for the receipt of articles therein;
- a lid movably mounted to the cabinet to selectively cover the opening and restrict access to the tub; and
- a filter assembly mounted to the lid to move therewith, the filter assembly comprising
  - an assembly box defining a box compartment and an assembly outlet upstream from the tub to direct liquid thereto, the assembly box being movable relative to the lid, and
  - a filter cartridge selectively received within the box compartment to filter liquid upstream from the assembly outlet.

2. The washing machine appliance of claim 1, wherein the filter assembly further comprises a support frame disposed within the assembly box, and wherein the filter cartridge is supported on the support frame.

3. The washing machine appliance of claim 2, wherein the support frame comprises a slotted cartridge scaffold extending downward towards the assembly outlet at a non-orthogonal angle relative to a vertical direction, and wherein the filter cartridge is held on the slotted cartridge scaffold.

4. The washing machine appliance of claim 1, wherein the filter assembly further defines a bypass outlet and a bypass path upstream therefrom, the bypass path in fluid parallel to the filter cartridge to selectively direct a fluid flow around the filter cartridge to the bypass outlet.

5. The washing machine appliance of claim 4, wherein the bypass path extends above the filter cartridge.

6. The washing machine appliance of claim 4, wherein the filter assembly comprises a mounting bracket fixed to the lid above the assembly box, and wherein the mounting bracket defines the bypass outlet above the assembly outlet.

7. The washing machine appliance of claim 1, further comprising:
- a circulation pump mounted within the cabinet in fluid communication with the tub to receive a fluid flow therefrom; and
- a supply conduit extending from the circulation pump to the filter assembly to supply the fluid flow to the assembly box.

8. The washing machine appliance of claim 7, wherein the filter assembly further defines an assembly inlet downstream from the supply conduit and upstream from the assembly outlet, and wherein the assembly inlet is disposed above the assembly outlet.

9. The washing machine appliance of claim 8, wherein the filter assembly comprises a mounting bracket fixed to the lid in support of the assembly box, and wherein the mounting bracket defines the assembly inlet.

10. The washing machine appliance of claim 1, wherein the assembly box is pivotably mounted to the lid.

11. A washing machine appliance comprising:
- a cabinet defining an opening;
- a tub disposed within the cabinet for the receipt of articles therein;
- a supply conduit disposed within the cabinet in fluid communication with the tub to receive a fluid flow therefrom;
- a lid movably mounted to the cabinet to selectively cover the opening and restrict access to the tub; and
- a filter assembly mounted to the lid to move therewith, the filter assembly comprising
  - a mounting bracket fixed to the lid in fluid communication with the supply conduit to receive the fluid flow therefrom,
  - an assembly box movably mounted to the mounting bracket to move relative thereto, the assembly box defining a box compartment and an assembly outlet upstream from the tub to direct liquid thereto, the assembly box being movable relative to the lid, and
  - a filter cartridge selectively received within the box compartment to filter liquid upstream from the assembly outlet.

12. The washing machine appliance of claim 11, wherein the filter assembly further comprises a support frame disposed within the assembly box, and wherein the filter cartridge is supported on the support frame.

13. The washing machine appliance of claim 12, wherein the support frame comprises a slotted cartridge scaffold extending downward towards the assembly outlet at a non-orthogonal angle relative to a vertical direction, and wherein the filter cartridge is held on the slotted cartridge scaffold.

14. The washing machine appliance of claim 11, wherein the filter assembly further defines a bypass outlet and a bypass path upstream therefrom, the bypass path in fluid parallel to the filter cartridge to selectively direct a fluid flow around the filter cartridge to the bypass outlet.

15. The washing machine appliance of claim 14, wherein the bypass path extends above the filter cartridge.

16. The washing machine appliance of claim 14, wherein the mounting bracket defines the bypass outlet above the assembly outlet.

17. The washing machine appliance of claim 11, further comprising:
- a circulation pump mounted within the cabinet in fluid communication with the tub to receive to the fluid flow therefrom, wherein the supply conduit extends from the circulation pump to the filter assembly to supply the fluid flow to the assembly box.

18. The washing machine appliance of claim 17, wherein the filter assembly further defines an assembly inlet downstream from the supply conduit and upstream from the assembly outlet, and wherein the assembly inlet is disposed above the assembly outlet.

19. The washing machine appliance of claim 18, wherein the mounting bracket defines the assembly inlet above the filter cartridge.

20. The washing machine appliance of claim 11, wherein the assembly box is pivotably mounted to the mounting bracket.

* * * * *